252-98 AU 166 EX
5/11/82 XR 4,329,245

United States Patent [19]
Eymond et al.

[11] 4,329,245
[45] May 11, 1982

[54] BLEACHING DETERGENT COMPOSITIONS

[75] Inventors: Philip R. N. Eymond; Robert M. Butterworth, both of Wirral, England

[73] Assignee: Lever Brothers Company, New York, N.Y.

[21] Appl. No.: 245,467

[22] Filed: Mar. 19, 1981

[30] Foreign Application Priority Data

Mar. 21, 1980 [GB] United Kingdom ..... 8009636

[51] Int. Cl.[3] ..... C11D 7/54
[52] U.S. Cl. ..... 252/102; 252/95; 252/98
[58] Field of Search ..... 252/102, 95, 98

[56] References Cited

U.S. PATENT DOCUMENTS 3,940,340 2/1976 Bucking et al. ..... 252/102

OTHER PUBLICATIONS

Amino Acid Chelating Agents in Detergent Applications, R. R. Pollard, Detergent Age, pp. 42–44, (Sep. 1966).

*Primary Examiner*—Mayer Weinblatt
*Attorney, Agent, or Firm*—Irving N. Feit; James J. Farrell; Melvin H. Kurtz

[57] ABSTRACT

A bleaching detergent composition comprising a nonionic detergent active compound, an inorganic persalt e.g. sodium perborate, an organic peracid precursor and a fluorescent agent, is stabilized by the use of a "sacrificial" ingredient. The "sacrificial" ingredient is an organic compound having a relative reactivity towards peracid and hydrogen peroxide of the order of 50:1 and a solubility in nonionic detergent active compounds at 25° C. of at least 0.15 grams/liter, e.g. alkanolamines, and is used in relatively small amounts, generally from 0.1 to 5.0% by weight.

7 Claims, No Drawings

BLEACHING DETERGENT COMPOSITIONS

This invention relates to bleaching detergent compositions, and in particular to so-called low temperature bleaching detergent compositions of the type functioning by the generation of organic peracids during use, for example peracetic acid, perbenzoic acid or substituted perbenzoic acid. Such compositions essentially comprise inorganic persalts, e.g. sodium perborate, and organic compounds which can react at relatively low temperatures, for example 20° to 60° C., with the persalts, or with hydrogen peroxide liberated by the persalts, to form organic peracids, which peracids, unlike the inorganic persalts, are effective in bleaching at lower temperatures. Hereinafter such organic compounds will be termed "organic peracid precursors" or "bleaching activators".

Alternatively the compositions may comprise the organic peracid as such instead of the combination of persalt and organic peracid precursor.

Generally, fabric washing detergent compositions also comprise fluorescent agents for improving the brightening activity of the compositions towards fabrics washed therewith. The fluorescent agents commonly used are derivatives of 4,4'-di(sym-triazinylamino)-stilbene-2,2'-disulphonic acid or salts thereof. Other fluorescent agents that have also been used for example are derivatives of diphenyldistyryl compounds, such as 4,4'-di(3-sulphostyryl)-diphenyl; derivatives of 4,4'-di(-triazolyl)-stilbene-2-2'-disulphonic acid and derivatives of diphenyl-Δ2-pyrazoline. Such fluorescent agents, however, when incorporated in low temperature bleaching detergent compositions are liable to decompose with consequent loss of fluorescent activity, possibly owing to interaction with the bleaching system present therein. This is especially true in the case of low temperature bleaching detergent compositions comprising a nonionic detergent active compound; the higher the proportion of the nonionic detergent active compound in the composition, the more unstable the fluorescent agent becomes.

It has been suggested to improve the stability of sensitive adjuncts, including fluorescent agents in detergent compositions, by presenting the adjunct with a carrier material in the form of granules, wherein the adjunct is dispersed throughout the granules, or by providing the adjunct with a protective coating, so as to minimise direct contact between the interacting ingredients. Apart from bringing in some solubility problem pregranulation of an ingredient will always mean an extra processing step in the manufacture of detergent compositions.

It has now been found that the stability of fluorescent agents in low temperature bleaching detergent compositions can be substantially improved by the use of a "sacrificial" ingredient. The "sacrificial" ingredient according to the invention will be any ingredient that is added in relatively small amounts to the composition for the sole or major purpose of being sacrificed to chemical attack during storage without deleteriously affecting the essential properties of the composition. Reactivity towards peracid and solubility in nonionic detergent active compounds are essential requirements for such an ingredient.

The sacrificial ingredient usable in the present invention should have a relative reactivity towards peracid and hydrogen peroxide in the order of 50:1 i.e. the ingredient should be relatively stable to peroxide and have a solubility in nonionic detergent active compounds at 25° C. of at least 0.15 grams/liter.

Examples of "sacrificial" ingredients according to the invention are alkanolamines, in which the alkanol moiety is a lower alcohol having 2–4 carbon atoms, such as monoethanolamine, diethanolamine, triethanolamine, monoisopropanolamine and monoisobutanolamine. Other suitable examples are nitrilotriacetic acid and its alkali metal salts.

Without wishing to be bound to any theory it is believed that said "sacrificial" ingredients in the composition of the invention prevent any peroxidative species from attacking the fluorescent agent.

Accordingly the invention provides a bleaching detergent composition comprising a nonionic detergent active compound, an inorganic persalt, an organic peracid precursor, a fluorescent agent and a "sacrificial" ingredient as defined hereinbefore.

The "sacrificial" ingredient of the invention is used in relatively small amounts. Generally an amount of from 0.1 to 5.0% by weight of the detergent composition will be adequate, preferably from 0.5 to 2.5, more preferably about 1.0% by weight.

The usual inorganic persalt is sodium perborate, which can be used as the monohydrate or tetrahydrate, but other inorganic persalts, for example percarbonates, perpyrophosphates and persilicates may alternatively be used. These may not be true inorganic persalts in the strict chemical sense but they are believed to contain hydrogen peroxide of crystallisation which is liberated in aqueous solution. The liberated hydrogen peroxide reacts with the organic peracid precursors to form the organic peracids.

The organic peracid precursors are typically compounds containing one or more acyl groups which are susceptible to perhydrolysis. Acetyl and benzoyl radicals are preferred, generating peracetic and perbenzoic acid, respectively. For commercial usage the perhydrolysis should be sufficiently fast and the organic peracid precursor sufficiently water-soluble for the organic peracid to be formed in a reasonable time. Moreover, the perhydrolysis must predominate over the competing hyrolysis reaction and the organic peracid formed must be sufficiently stable for the desired bleaching to occur under the laundering conditions employed. Specific organic peracid precursors which may be mentioned by way of example are (1) esters such as sodium acetoxybenzene sulphonate, chloroacetoxy salicylic acid and polyglycollic acids; (2) acylsubstituted cyanurates such as triacetylcyanurate; (3) amides, particularly acetylated alkyl amines such as N,N,N',N'-tetraacetylethylene diamine; α-acyloxy-(N,N')polyacylmalonamides such as α-acetoxy-(N,N')-diacetylmalonamide; (4) N-acylazoles such as N-acetyl imidazole and N-benzoyl imidazole; (5) acylated barbitones, hydantoins and glycolurils such as N,N'-diacetyl barbitone, N,N'-diacetyl-5,5-dimethylhydantoin and N,N,N',N'-tetraacetylglycoluril, respectively. Many other organic peracid precursors are known and described, sometimes as bleaching activators, in literature, for example in British Pat. Nos. 836,988 and 855,735, and U.S. Pat. No. 4,128,494, the disclosure of which are included by reference herein.

A preferred organic peracid precursor is N,N,N',N'-tetraacetylethylenediamine.

The amounts of the inorganic persalt and the organic peracid precursor are generally within the range of 3 to 35% by weight and 0.1–15% by weight, respectively, in the detergent composition. The ratio of the inorganic persalt to the organic peracid precursor can vary, depending on the number of reactive acyl radicals per molecule of the organic peracid precursor and/or the type of bleaching performance profile contemplated, lying generally between the range of 1:1 to 35:1, preferably between 2:1 and 20:1.

The fluorescent agents which are used in the low temperature bleaching detergent compositions of the invention are well known and many such fluorescent agents are available commercially. Specific fluorescent agents which may be mentioned by way of example are:

(a) 4,4'-di(2''-anilino-4''-morpholinotriazin-6''-ylamino)-stilbene-2,2'-disulphonic acid and its salts,
(b) 4,4'-di(2''-anilino-4''-N-methylethanolaminotriazin-6''-ylamino)-stilbene-2,2'-disulphonic acid and its salts,
(c) 4,4'-di(2''-anilino-4''-diethanolaminotriazin-6''-ylamino)-stilbene-2,2'-disulphonic acid and its salts,
(d) 4,4'-di(2''-anilino-4''-dimethylaminotriazin-6''-ylamino)-stilbene-2,2'-disulphonic acid and its salts,
(e) 4,4'-di(2''-anilino-4''-diethylaminotriazin-6''-ylamino)-stilbene-2,2'-disulphonic acid and its salts,
(f) 4,4'-di(2''-anilino-4''-monoethanolaminotriazin-6''-ylamino)-stilbene-2,2'-disulphonic acid and its salts,
(g) 4,4'-di(2''-anilino-4''-(1-methyl-2-hydroxy)ethylaminotriazin-6''-ylamino)-stilbene-2,2'-disulphonic acid and its salts,
(h) 4,4'-di(2''-methylamino-4''-p-chloroanilinotriazin-6''-ylamino)-stilbene-2,2'-disulphonic acid and its salts,
(i) 4,4'-di(2''-diethanolamine-4''-sulphanilinotriazin-6''-ylamino)-stilbene-2,2'-disulphonic acid and its salts,
(j) 4,4'-di(3-sulphostyryl)diphenyl and its salts,
(k) 4,4'-di(4-phenyl-1,2,3-triazol-2-yl)-stilbene-2,2'-disulphonic acid and its salts,
(l) 1-(p-sulphonamidophenyl)-3-(p-chlorophenyl)-$\Delta^2$-pyrazoline.

Usually these fluorescent agents are supplied and used in detergent compositions in the form of their alkali metal salts, for example, the sodium salts. In addition to these fluorescent agents, the detergent composition of the invention may contain other types of fluorescent agents as desired. The total amount of the fluorescent agent or agents used in a detergent composition is generally from 0.02–2.0% by weight.

The detergent composition of the invention will contain at least one nonionic detergent active compound, which may be combined with anionic, cationic, or amphoteric detergents. The detergent active content of the detergent composition will generally be from about 3 to about 40%, preferably 10 to 35% by weight of the detergent composition. Preferably the detergent composition comprises a nonionic detergent active compound in a proportion of at least 20%, preferably at least 50% by weight of the total detergent active content.

Typical anionic detergent-active compounds are water-soluble or water-dispersible salts of various organic acids. The cations of such salts are generally alkali-metals, such as sodium and, less preferably, potassium, but other cations, such as ammonium and substituted ammonium, can be used if desired. Examples of suitable organic acids are: alkyl benzene sulphonic acids, the alkyl chains of which contain from about 8 to about 20 carbon atoms, such as p-dodecyl benzene sulphonic acid and linear alkyl ($C_{10-15}$) benzene sulphonic acid; the mixtures of sulphonic acids obtained by reacting linear and branched olefins, particularly linear "cracked-wax" or "Ziegler" alpha-olefins, containing from about 8 to about 22 carbon atoms, with sulphur trioxide; alkyl sulphonic acids obtained by reacting alkanes containing from about 8 to about 22 carbon atoms with sulphur dioxide/oxygen or sulphur dioxide/chlorine (followed by hydrolysis in the latter case), or by the addition of bisulphite to olefins, particularly linear "cracked-wax" or "Ziegler" alpha-olefins, containing from about 8 to about 22 carbon atoms; alkyl sulphuric acids obtained by reacting aliphatic alcohols containing from about 8 to about 22 carbon atoms with sulphur trioxide; alkyl ether sulphuric acids, obtained by reacting molar quantities of aliphatic alcohols containing from about 6 to about 18 carbon atoms with from about 1 to about 15 moles of ethylene oxide, or a suitable mixture of ethylene oxide and propylene oxide, and subsequently reacting the alkoxylated alcohol with sulphur trioxide to yield the required acid; and natural or synthetic aliphatic carboxylic acids, particularly those derived from natural sources such as tallows, coconut oil, palm oil, palm kernel oil and groundnut oil.

Examples of suitable nonionic detergent-active compounds are condensates of alkyl-phenols having an alkyl group (derived, for example, from polymerized propylene, diisobutylene, octene, dodecene or nonene) containing from about 6 to 12 carbon atoms in either a straight chain or branched chain configuration, with about 5 to 25 moles of ethylene oxide per mole of alkylphenol; condensates containing from about 40 percent to about 80 percent polyoxyethylene by weight and having a molecular weight of from about 5,000 to about 11,000 resulting from the reaction of ethylene oxide with the reaction product of ethylenediamine and excess propylene oxide; condensates of linear or branched-chain aliphatic alcohols containing from 8 to 18 carbon atoms with ethylene oxide, e.g. a coconut alcohol-ethylene oxide condensate containing about 6 to 30 moles of ethylene oxide per mole of coconut alcohol; long-chain tertiary amine oxides corresponding to the general formula $R_1R_2R_3N\rightarrow 0$, wherein $R_1$ is an alkyl radical containing from about 8 to 18 carbon atoms and $R_2$ and $R_3$ are each methyl, ethyl or hydroxy ethyl radicals, such as dimethyldodecylamine oxide, dimethyloctylamine oxide, dimethylhexadecylamine oxide and N-bis (hydroxyethyl) dodecylamine oxide; long-chain tertiary phosphine oxides corresponding to the general formula $RR'R''P\rightarrow 0$, wherein R is an alkyl, alkenyl or monohydroxyalkyl radical containing from 10 to 18 carbon atoms and R' and R'' are each alkyl or monohydroxyalkyl groups containing from one to three carbon atoms, such as dimethyldodecylphosphine oxide, dimethyltetradecylphosphine oxide, ethylmethyltetradecylphosphine oxide, dimethylstearylphosphine oxide, ethylpropylcetylphosphine oxide, diethyldodecylphosphine oxide, bis (hydroxymethyl) dodecylphosphine oxide, bis (2-hydroxyethyl) dodecylphosphine oxide, 2-hydroxypropylmethyltetradecylphosphine oxide, dimethyloleylphosphine oxide and dimethyl-2-hydroxydodecylphosphine oxide; and dialkyl sulphoxides corresponding to the general formula $RR'S\rightarrow 0$, wherein R is an alkyl, alkenyl, beta- or gamma-monohydroxyalkyl radical or an alkyl or beta- or gamma-monohydroxyalkyl radical containing one or two other oxygen atoms in the chain, the R groups containing from 10 to 18 carbon atoms and wherein R' is methyl, ethyl or alkylol radical, such as dodecyl methyl sulphoxide, tetradecyl methyl sulphoxide, 3-hydroxytridecyl methyl sulphoxide, 2-hydroxydodecyl methyl sulphoxide, 3-hydroxy-4-dodecyloxybutyl methyl sulphoxide, 2-hydroxy-3-decyloxypropyl methyl sulphoxide, dodecyl ethyl sulphoxide, 2-hydroxydodecyl ethyl sulphoxide and dodecyl-2-hydroxyethyl sulphoxide.

Examples of suitable amphoteric detergent-active compounds are: derivatives of aliphatic secondary and tertiary amines, in which the aliphatic radical may be straight chain or branched and wherein one of the aliphatic substituents contains from about 8 to 18 carbon atoms and one contains an anionic water solubilizing group, such as sodium-3-dodecylaminoproprionate, sodium-3-dodecylaminopropane sulphonate and sodium N-2-hydroxydodecyl-N-methyl-taurate; and derivatives of aliphatic quaternary ammonium compounds, sulphonium compounds and phosphonium compounds in which the aliphatic radical may be straight chain or branched and wherein one of the aliphatic substituents contains from about 8 to 18 carbon atoms and one contains an anionic water solubilizing group, such as 3-(N,N-dimethyl-N-hexadecylammonium) propane-1-sulphonate betaine, 3-(N,N-dimethyl-N-hexadecylammonium)-2-hydroxy-propane-1-sulphonate betaine, 3-(dodecylmethylsulphonium) propane-1-sulphonate betaine, and 3-(cetylmethylphosphonium) ethane sulphonate betaine.

Further examples of suitable detergent-active compounds commonly used in the art are given in "Surface Active Agents", Volume 1, by Schwartz and Perry (Interscience 1949) and "Surface Active Agents" Volume II, by Schwartz, Perry and Berch (Interscience 1958), the disclosures of which are included by way of reference herein.

Hence, in a more specific embodiment, a detergent composition of the invention comprises:

(a) from 3 to 40% by weight of a detergent active compound, comprising a nonionic detergent and optionally anionic, cationic and amphoteric detergents and mixtures thereof;
(b) from 3 to 35% by weight of an inorganic persalt;
(c) from 0.1 to 15% by weight of an organic peracid precursor;
(d) from 0.02 to 2% by weight of a fluorescent agent; and
(e) from 0.1 to 5.0% by weight of a "sacrificial" ingredient as defined hereinbefore.

Generally, a detergent composition of the invention will also include one or more detergency builders. Usually the total amount of detergency builders in a detergent composition of the invention will be from about 5 to about 70 percent by weight of the detergent composition. Many detergency builders are known, and those skilled in the art of formulating fabric-washing detergent compositions will be familiar with these materials. Examples of known detergency builders are sodium tripolyphosphate; sodium orthophosphate; sodium pyrophosphate; sodium trimetaphosphate; sodium ethane-1-hydroxy-1,1-diphosphonate; sodium carbonate; sodium silicate; sodium citrate; sodium oxydiacetate; sodium ethylenediaminetetraacetate; sodium salts of long-chain dicarboxylic acids, for instance straight chain ($C_{10}$ to $C_{20}$) succinic acids and malonic acids; sodium salts of alpha-sulphonated long-chain monocarboxylic acids; sodium salts of polycarboxylic acids, i.e. acids derived from the polymerization or copolymerization of unsaturated carboxylic acids and unsaturated carboxy acid anhydrides such as maleic acid, acrylic acid, itaconic acid, methacrylic acid, crotonic acid and aconitic acid, and the anhydrides of these acids, and also from the copolymerization of the above acids and anhydrides with minor amounts of other monomers, such as vinyl chloride, vinyl acetate, methyl metacrylate, methyl acrylate and styrene; modified starches such as starches oxidized, for example using sodium hypochlorite, in which some anhydroglucose units have been opened to give dicarboxylic units; and the various sodium aluminosilicate builders.

Further, a detergent composition of the invention may contain any of the conventional detergent composition ingredients in any of the amounts in which such conventional ingredients are usually employed therein. Examples of these additional ingredients are lather boosters, such as coconut mono-ethanolamide and palm kernel monoethanolamide; lather controllers; inorganic salts such as sodium sulphate and magnesium sulphate; hypohalite-releasing bleaching agents such as trichloroisocyanuric acid and sodium and potassium dichloroisocyanurates; antiredeposition agents, such as sodium carboxymethylcellulose; stabilising agents, such as the organic phosphonate compounds; perfumes; colorants; enzymes; corrosion inhibitors and germicides.

A detergent composition of the invention can be prepared using any of the conventional manufacturing techniques commonly used or proposed for the preparation of detergent compositions, such as slurry-making, followed by spray-drying or spray-cooling, and subsequently dry-dosing of sensitive ingredients not suitable for incorporation prior to the drying step. The inorganic persalts and organic peracid precursors, and enzymes and metallic chelate catalysts, are examples of such sensitive ingredients. Other conventional techniques, such as noodling, granulation and mixing by fluidization in a fluidized bed, may be utilized as and when necessary. Such techniques are familiar to those skilled in the art of detergent composition manufacture.

By using such conventional manufacturing techniques, a detergent composition of the invention may be prepared in any of the common physical forms associated with detergent compositions, such as powders, flakes, granules, noodles, cakes and bars.

The invention is illustrated in the following Examples, wherein all parts and percentages are given by weight.

EXAMPLES I–IV

In these Examples model experiments were used to determine the fluorescer stability under accelerated conditions. The results are shown in the Tables 1–4.

Model experiment

Fluorescer (2 g) is dissolved/dispersed in the liquid active detergent (58 g) with stirring at 22° C. To this solution/dispersion is added water (20 g) in which the "sacrificial" ingredient has been dissolved/dispersed. The thoroughly mixed composition is transferred to a glass bottle. An intimate solid mix comprising organic peracid precursor (7 g) and persalt (13 g) is then added, the whole well stirred and the bottle closed with a screw top. The bottle containing the reaction mixture is then placed in an oven at 40° C. The fluorescer content of the mixture is analysed at noted intervals over a period of 60 hours. For this an aliquot of the reaction mixture (10 g) is removed, diluted with cold water and a portion placed in 1 cm quartz optical cell. The fluorescence of the solution is measured using a spectrophoto fluorimeter. Fluorescer content is quantified by reference of the fluorescence reading to that of a series of standard solutions of known fluorescer concentration.

Fluorescent agent: Disodium 4,4'-di(2''-anilino-4''-morpholino triazin-6''-ylamino)-stilbene-2,2'-disulphonate.

Active detergent: Synperonic ® A7 ex ICI; ethoxylated primary alcohol.

Organic peracid precursor: N,N,N',N'-tetraacetylethylene diamine.

Persalt: Sodium perborate tetrahydrate.

TABLE 1

I. "Sacrificial" ingredient = Triethanolamine (TEA)

| Reaction time (hours) | % Fluorescent agent remaining | | | |
|---|---|---|---|---|
| | Control | 0.1M TEA added | 0.2M TEA added | 0.3M TEA added |
| 0 | 100.0 | 100.0 | 100.0 | 100.0 |
| 2 | 85.0 | 100.0 | 100.0 | 100.0 |
| 20 | 20.5 | 82.0 | 100.0 | 100.0 |
| 40 | 10.0 | 50.5 | 75.0 | 97.5 |
| 60 | 5.5 | 35.5 | 57.0 | 90.0 |

TABLE 2

II. "Sacrificial" ingredient = Diethanolamine (DEA)

| Reaction time (hours) | % Fluorescent agent remaining | | | |
|---|---|---|---|---|
| | Control | 0.1M DEA added | 0.2M DEA added | 0.3M DEA added |
| 0 | 100.0 | 100.0 | 100.0 | 100.0 |
| 2 | 85.0 | 100.0 | 100.0 | 100.0 |
| 20 | 20.5 | 82.0 | 92.0 | 99.0 |
| 40 | 10.0 | 50.0 | 68.0 | 90.0 |
| 60 | 5.5 | 35.5 | 52.5 | 78.0 |

TABLE 3

III. "Sacrificial" ingredient = Monoethanolamine (MEA)

| Reaction time (hours) | % Fluorescent agent remaining | | | |
|---|---|---|---|---|
| | Control | 0.1M MEA added | 0.2M MEA added | 0.3M MEA added |
| 0 | 100.0 | 100.0 | 100.0 | 100.0 |
| 2 | 85.0 | 100.0 | 100.0 | 100.0 |
| 20 | 20.5 | 82.0 | 93.5 | 94.0 |
| 40 | 10.0 | 50.5 | 70.0 | 80.5 |
| 60 | 5.5 | 35.0 | 55.0 | 66.5 |

TABLE 4

IV. "Sacrificial" ingredient = Potassium nitrilotriacetate (NTA)

| Reaction time (hours) | % Fluorescent agent remaining | |
|---|---|---|
| | Control | 0.3M NTA added |
| 0 | 100.0 | 100.0 |
| 2 | 85.0 | 100.0 |
| 20 | 20.5 | 92.5 |
| 40 | 10.0 | 85.5 |
| 60 | 5.5 | 82.0 |

EXAMPLE V

The effect of TEA on the following fluorescent agents was investigated in a model experiment as described in Examples I–IV.

Fluorescer A: Dipotassium 4,4'-di-(4-phenyl-1,2,3-triazol-2-yl)-2,2'-stilbene disulphonate.

Fluorescer B: Disodium 4,4'-di-(2-sulphostyryl)diphenyldisulphonate.

Fluorescer C: 1-(p-sulphonamidophenyl)-3-(p-chlorophenyl)-$\Delta^2$-pyrazoline.

TABLE 5

| Reaction time (hours) | % Fluorescent agent remaining | | | | | |
|---|---|---|---|---|---|---|
| | Fluorescer A | | Fluorescer B | | Fluorescer C | |
| | Control | 0.3M TEA added | Control | 0.3M TEA added | Control | 0.3M TEA added |
| 0 | 100.0 | 100.0 | 100.0 | 100.0 | 100.0 | 100.0 |
| 2 | 100.0 | 100.0 | 98.0 | 100.0 | 90.0 | 100.0 |
| 20 | 97.0 | 100.0 | 85.0 | 100.0 | 41.5 | 100.0 |
| 40 | 91.0 | 100.0 | 70.0 | 100.0 | 18.0 | 90.0 |
| 60 | 85.0 | 100.0 | 62.5 | 100.0 | 12.5 | 85.5 |

EXAMPLE VI

The following two powders A and B were prepared. The powders were prepared by spray-drying an aqueous slurry comprising all ingredients except the sodium perborate and the tetraacetylethylene diamine (TAED) which were added to the spray-dried base powder by a dry-mixing process.

| Compositions | Parts by weight | |
|---|---|---|
| | Powder A | Powder B |
| $C_{12}$-$C_{15}$ alcohol-7 EO | 12.0 | 12.0 |
| sodium triphosphate | 34.2 | 34.2 |
| alkaline sodium silicate | 10.0 | 10.0 |
| sodium sulphate | 11.4 | 11.4 |
| sodium carboxymethylcellulose | 0.6 | 0.6 |
| fluorescent agent* | 0.3 | 0.3 |
| TAED | 7.0 | 7.0 |
| sodium perborate | 13.0 | 13.0 |
| TEA | — | 0.8 |
| water | to 100.0 | to 100.0 |

*Disodium 4,4'-di(2''-anilino-4''-morpholinotriazin-6''-ylamino)-stilbene-2,2'-disulphonate.

Samples of the powders were stored in non-laminated cardboard cartons under conditions of either 37° C./70% relative humidity or 28° C./70% relative humidity.

At noted time intervals during storage samples of the powders were removed, dissolved in a solution of dimethoxy ethane (80 parts) and 0.1 M NaOH (20 parts) and the fluorescent agent content of the solution determined using the spectrophotofluorimeter technique as described in the model experiment.

The following results were obtained.

TABLE 6

| Storage time (weeks) | % Fluorescent agent remaining | | | |
|---|---|---|---|---|
| | 37° C./70% RH | | 28° C./70% RH | |
| | Powder A | Powder B | Powder A | Powder B |
| 0 | 100.0 | 100.0 | 100.0 | 100.0 |
| 2 | 86.5 | 100.0 | 100.0 | 100.0 |
| 4 | 45.0 | 96.0 | 84.0 | 100.0 |
| 6 | 10.0 | 65.5 | 62.0 | 100.0 |
| 8 | 5.0 | 30.0 | 48.0 | 96.5 |

The results clearly show that the fluorescent agent in powder B is categorically more stable than in powder A under both storage conditions.

We claim:

1. A bleaching detergent composition comprising:

(a) 3 to 40% by weight of a detergent active compound comprising a nonionic detergent;

(b) 3 to 35% by weight of an inorganic persalt;

(c) 0.1 to 15% by weight of an organic peracid precursor, which can react with the persalt to form organic peracids;

(d) 0.02 to 2% by weight of a fluorescent agent selected from the group consisting of:

(i) derivatives of 4,4'-di(sym-triazinylamino)-stilbene-2,2'-disulphonic acid and their salts;

(ii) derivatives of diphenyl-distyryl compounds and their salts;

(iii) derivatives of 4,4'-di(triazolyl)-stilbene-2,2'-disulphonic acid and their salts; and (iv) derivatives of diphenyl-2-pyrazoline; and (e) 0.1 to 5.0% by weight of an alkanolamine, in which the alkanol moiety is a lower alcohol having 2 to 4 carbon atoms.

2. A bleaching detergent composition according to claim 1, wherein said "sacrificial" ingredient is present in an amount of 0.5 to 2.5% by weight of the composition.

3. A bleaching detergent composition comprising:

(a) 3 to 40% by weight of a detergent active compound comprising a nonionic detergent;

(b) 3 to 35% by weight of an inorganic persalt;

(c) 0.1 to 15% by weight of an organic peracid precursor, which can react with the persalt to form organic peracids;

(d) 0.02 to 2% by weight of a fluorescent agent selected from the group consisting of:

(i) derivatives of 4,4'-di(sym-triazinylamino)-stilbene-2,2'-disulphonic acid and their salts;

(ii) derivatives of diphenyl-distyryl compounds and their salts;

(iii) derivatives of 4,4'-di(triazolyl)-stilbene-2,2'-disulphonic acid and their salts; and (iv) derivatives of diphenyl-2-pyrazoline; and (e) 0.1 to 2.5% by weight of nitrilotriacetic acid or an alkali metal salt thereof.

4. A bleaching detergent composition according to claim 1 or 3, wherein the nonionic detergent comprises at least 20% by weight of the total detergent active content.

5. A bleaching detergent composition according to claim 1 or 3, wherein the nonionic detergent comprises at least 50% by weight of the total detergent active content.

6. A bleaching detergent composition according to claim 1 or 3, wherein the inorganic persalt is sodium perborate.

7. A bleaching detergent composition according to claim 1 or 3, wherein the organic peracid precursor is N,N,N',N'-tetraacetylethylene diamine.

* * * * *